US007453197B2

(12) United States Patent
Andoh

(10) Patent No.: US 7,453,197 B2
(45) Date of Patent: Nov. 18, 2008

(54) IMAGE DISPLAY APPARATUS WITH WARPED SHAPE

(75) Inventor: Tomokazu Andoh, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 477 days.

(21) Appl. No.: 11/300,456

(22) Filed: Dec. 15, 2005

(65) Prior Publication Data

US 2006/0138934 A1 Jun. 29, 2006

(30) Foreign Application Priority Data

Dec. 28, 2004 (JP) ..... 2004-379827

(51) Int. Cl.
*H01J 1/62* (2006.01)
*H01J 5/02* (2006.01)

(52) U.S. Cl. ..... 313/496; 313/495

(58) Field of Classification Search ..... 313/495–497
See application file for complete search history.

(56) References Cited

U.S. PATENT DOCUMENTS 5,015,912 A * 5/1991 Spindt et al. ..... 313/495
5,811,928 A * 9/1998 Hill ..... 313/496
2005/0189865 A1* 9/2005 Lee ..... 313/495

FOREIGN PATENT DOCUMENTS

| | | | |
|---|---|---|---|
| JP | 5-174742 | | 7/1993 |
| JP | 08-17185 | * | 7/1996 |
| JP | 8-171875 | | 7/1996 |
| JP | 2003-109528 | | 4/2003 |

* cited by examiner

*Primary Examiner*—Karabi Guharay
(74) *Attorney, Agent, or Firm*—Fitzpatrick, Cella, Harper & Scinto

(57) ABSTRACT

A display apparatus having a first plate-shaped member having plural electron-emitting devices which are dispersively distributed and a second plate-shaped member having a plurality of light-emitting members arranged on a surface which faces the first plate-shaped member in correspondence to the plural electron-emitting devices, in which in at least either the first plate-shaped member or the second plate-shaped member, directions of normal lines extending from the plural electron-emitting devices or the plural light-emitting members are distributed in a tendency. A pitch of arranging the adjacent electron-emitting devices and a pitch of arranging the light-emitting members corresponding to the adjacent electron-emitting devices are different in accordance with the distribution of the normal-line directions.

4 Claims, 8 Drawing Sheets

IMAGE DISPLAY APPARATUS WITH WARPED SHAPE

BACKGROUND OF THE INVENTION

1. Field of the Invention

The invention relates to an image display apparatus using electron-emitting devices.

2. Related Background Art

Flat panel type image display apparatuses have been vigorously being studied and developed as display apparatuses of images, characters, and the like. A large panel display screen size and high definition are demanded for the flat panel type-image display apparatuses.

In a PDP, an LCD, and an SED (surface conduction type electron-emitting device display) as flat panel type image display apparatuses, flat panel glass is used and a thickness of image display apparatus lies within a range from a few cm to tens of cm and is thinner than general CRTs. Although those display apparatuses are of the flat panel type, actually they have a warp of about a few mm or less which is caused due to a manufacturing processor the like. There is a case where a color variation and a luminance variation are caused by such a warp.

The image display apparatus in which such a warp occurred has been disclosed in for example, JP-A-2003-109528 and is shown in FIG. 13.

FIG. 13 is a schematic cross sectional view of a panel main body using electron-emitting devices. A frame-shaped supporting spacer 40 is interposed between a face plate 30 and a rear plate 20 in which a number of electron-emitting devices 10 are arranged in a matrix shape on one surface side. A space formed by those plates 20 and 30 and the spacer 40 is held in a vacuum state. A collector electrode made of an ITO film is formed on the surface of the face plate 30 which faces the rear plate 20. Each electron-emitting device 10 is arranged every sub-pixel 32 consisting of one phosphor cell (phosphor layer). Each sub-pixel 32 is excited by an electron beam which is irradiated from the electron-emitting device 10 and emits light to a color region of one of the three primary colors of R, G, and B. As shown in the diagram, the face plate 30 has a curved shape which is convex to an outer surface side.

As for the sub-pixels 32 provided for the face plate 30, a pitch between the sub-pixels 32 is set so that sizes of projection images onto the one surface of the rear plate 20 in the sub-pixels 32 are made coincident. Therefore, the projection image of the sub-pixel 32 is almost equal to the surface shape of the electron-emitting device 10 and is overlapped to the electron-emitting device 10. Consequently, it is possible to prevent the electron emitted from the adjacent electron-emitting device 10 from reaching, a blur of an image can be prevented, and color reproducibility can be improved.

FIG. 1 is a schematic cross sectional view schematically showing a structure of a panel which is used in the flat panel type image display apparatus. Reference numeral 101 denotes a rear plate; 102 a face plate; 103 a frame; and 104 a panel obtained by sealing and bonding the rear plate 101, face plate 102, and frame 103 by a panel sealing step. The inside of the panel 104 is held in a vacuum state. Reference numeral 105 denotes an electron source pattern formed on the surface of the rear plate 101 which faces the face plate 102. The electron source pattern 105 is formed by a plurality of electron-emitting devices. Reference numeral 106 denotes a phosphor pattern formed on the surface of the face plate 102 which faces the rear plate 101. The phosphor pattern 106 is formed by a plurality of phosphor (light-emitting members) and each phosphor corresponds to each electron-emitting device.

There is a case where a temperature difference or the like occurs between the rear plate 101 and the face plate 102 in a thermal process in the panel sealing step. Thus, there is a case where the rear plate 101 and the face plate 102 which were almost flat surfaces before the panel sealing step are warped after that, so that the panel 104 is warped as illustrated in FIG. 1.

There is also a case where the fear plate 101 or the face plate 102 is sealed and bonded in the panel sealing step by using a hot plate while being pressed, or the like. In the hot plate, there is a case where a slight warp is caused by a thermal distortion and the hot plate becomes a non-flat surface after the sealing step is repetitively executed.

In the panel in which such a temperature difference occurs or the panel which was sealed and bonded by the warped hot plate, a warp occurs and the panel becomes the non-flat surface. Such a warp becomes remarkable with an increase in panel size.

In the flat panel type display apparatus, there is a case where a spacer is interposed between the face plate and the rear plate so that a space between the rear plate 101 and the face plate 102 is not broken by the atmospheric pressure. In the case of such a construction, since the rear plate 101 and the face plate 102 are pressed to the spacer by the atmospheric pressure, a macroscopic radius of curvature of the whole rear plate 101 and that of the whole face plate 102 almost coincide.

It is now presumed the panel 104 in which the electron source pattern 105 and the phosphor pattern 106 are formed at the same size on the rear plate 101 and the face plate 102 in the almost flat surface state, respectively, and the panel 104 is sealed and bonded so that a center position of the rear plate 101 and that of the face plate 102 coincide. An electron beam emitted from the electron-emitting device is irradiated in the direction of a normal line of the rear plate in the electron-emitting device. Therefore, if the panel is warped by the foregoing reasons, a difference of $\delta/2$ occurs in each of both ends as shown in FIG. 1.

In other words, a position of a center of gravity of phosphor which should inherently exist does not exist in the direction of a normal line of a position of a center of gravity of a certain electron-emitting device or apposition of a center of gravity of the emitted electron beam, so that a deviation occurs in an irradiating position of the electron beam to the face plate. Such a situation is illustrated in FIG. 14.

When the electron beam is deflected by a deflecting voltage or the like, an ideal position of the center of gravity of phosphor is set in consideration of its deflection amount and a similar idea is used.

Although such a positional deviation due to the warp is small at the center of a display screen, it increases as a position approaches an outer position of the display screen. When the positional deviation is small, there is no problem as picture quality.

However, as the positional deviation amount increases, the electron beam is deviated from phosphor to be inherently irradiated by the electron beam, so that luminance decreases. Further, when the positional deviation increases, phosphor adjacent to phosphor to be inherently irradiated by the electron beam is irradiated, so that a color drift occurs in the case of a color television. Such a color drift becomes a typical problem with an increase in size of display screen.

The decrease in the luminance can be suppressed to a certain extent by increasing a size of phosphor to a value larger than abeam size. However, in the case of a high-definition display apparatus, the positional deviation becomes a remarkable problem.

As mentioned above, the positional deviation which is caused by the warp of the airtight container (panel) will become an important problem in association with the realization of a large screen size and high definition of the image display apparatus in the future.

SUMMARY OF THE INVENTION

According to the invention which solves the above problems, there is provided a display apparatus comprising a first plate-shaped member having a plurality of electron-emitting devices which are dispersively distributed and a second plate-shaped member having a plurality of light-emitting members arranged on a surface which faces the first plate-shaped member in correspondence to the plurality of electron-emitting devices, in which in at least either the first plate-shaped member or the second plate-shaped member, directions of normal lines extending from the plurality of electron-emitting devices or the plurality of light-emitting members are distributed in a tendency, wherein a pitch between at least a part of the electron-emitting devices and an electron-emitting device adjacent to the electron-emitting device and a pitch between a light-emitting member corresponding to the electron-emitting device and a light-emitting member adjacent to the light-emitting member are different so that an electron emitted from each of the plurality of electron-emitting devices is irradiated to each of the plurality of corresponding light-emitting members.

DETAILED DESCRIPTION OF THE PREFERRED EMBODIMENTS

Figure 1:
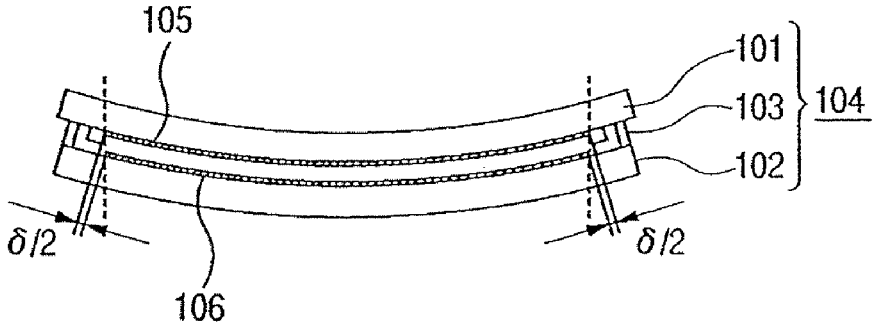
FIG. 1 is a schematic cross sectional view schematically showing a structure of a panel.
Figure 2:
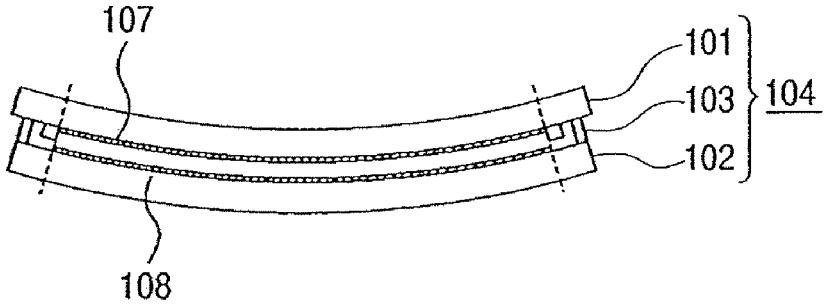
FIG. 2 is a schematic cross sectional view schematically showing a structure of a panel.

FIG. 2 is a schematic cross sectional view schematically showing a structure of a panel of the invention. Reference numeral 101 denotes the rear plate; 102 the face plate; 103 the frame; and 104 the panel obtained by sealing and bonding the rear plate 101, face plate 102, and frame 103 by the panel sealing step. The panel 104 has a non-flat shape in which the surface of the face plate 102 side is convex. The frame 103 is fixed by a sealing material (not shown) having a sealing function to keep a vacuum hermetical state. The inside of the panel 104 is held in a vacuum state. Reference numeral 107 denotes an electron source pattern formed on the surface of the rear plate 101 which faces the face plate 102. The electron source pattern 107 is formed by a plurality of electron-emitting devices. Reference numeral 108 denotes a phosphor pattern formed on the surface of the face plate 102 which faces the rear plate 101. The phosphor pattern 108 is formed by a plurality of phosphor (light-emitting members) and each phosphor corresponds to each electron emitting device. By forming the phosphor pattern 108 so as to be longer (larger) than the electron source pattern 107, the occurrence of the relative positional deviation between the patterns can be prevented in the state of the warped panel 104.

The following two methods of causing a difference between the relative pattern sizes can be mentioned.

(1) A size of phosphor pattern is used as a reference and a size of electron source pattern is changed.

(2) The size of electron source pattern is used as a reference and the size of phosphor pattern is changed.

The size of phosphor pattern denotes a distance between both ends of the phosphor pattern. The size of electron source pattern denotes a distance between both ends of the electron source.

Since an image is determined by the phosphor pattern, the method (1) is preferable. However, if the method (1) is difficult to be used depending on a manufacturing process or the like, the method (2) can be also used.

The following two methods of changing the size of pattern can be mentioned.

(3) A phosphor pitch (pitch of arranging the light-emitting members) and an electron-emitting device pitch (pitch of arranging the electron-emitting devices) are made different without changing one phosphor size or one electron-emitting device size.

(4) The phosphor pitch and the electron-emitting device pitch are equalized and one phosphor size or one electron-emitting device size is made different.

Even by changing the phosphor size and the electron source size, if no change appears in the luminance, the method (4) may be used. However, if a change occurs in the luminance, the method (3) is properly used.

To realize high definition or increase a relative positioning margin of the rear plate 101 and the face plate 102 in the sealing step, it is desirable to select the methods (1) and (3).

Figure 3:
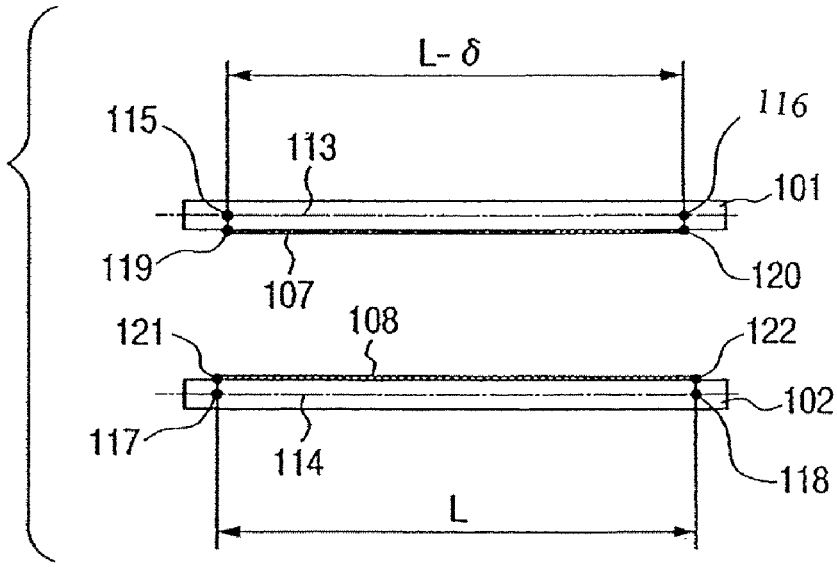
FIG. 3 shows a state before a sealing step.
Figure 4:
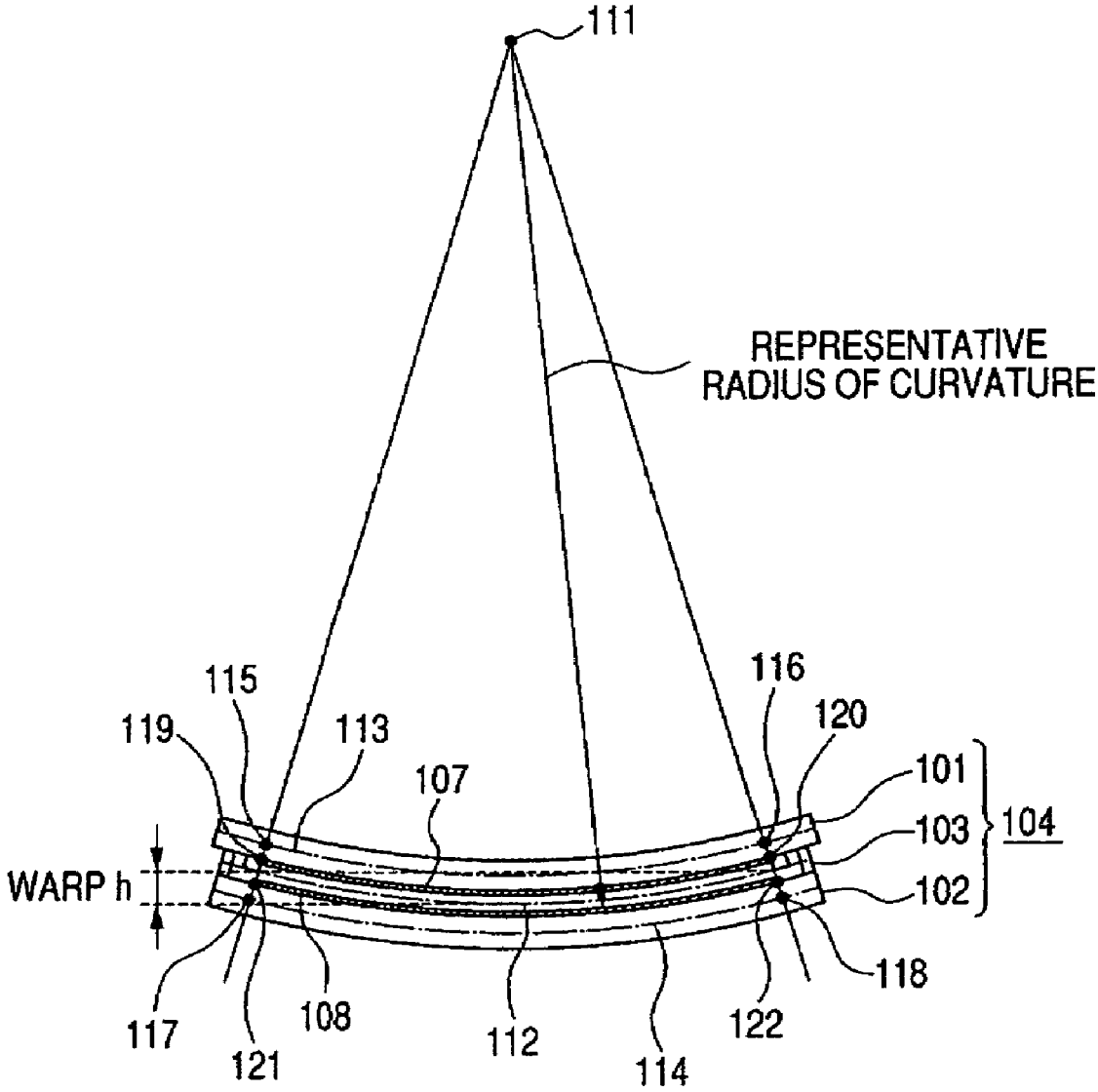
FIG. 4 is a schematic cross sectional view of a panel 104 obtained after the sealing step.

Subsequently, the difference of the pattern sizes is quantitatively calculated from the warped shape of the panel 104. FIG. 3 shows the state before the sealing step. FIG. 4 shows a schematic cross sectional view of the panel.

In FIG. 3, reference numeral 113 denotes a neutral plane of the rear plate 101; 114 a neutral plane of the face plate 102; 119 a point A'; and 120 a point B'. The points A' and B' are both ends of the electron source pattern 107. Reference numeral 115 denotes a point A and 116 indicates a point B. The points A and B are points obtained by projecting the points A' 119 and B' 120 to the neutral plane 113 of the rear plate. When a distance between the points A and B is assumed to be L−δ, a distance between the points A' and B' is also equal to L−δ. The neutral plane denotes a virtual plane locating at a center portion in the depth direction of each member.

Reference numeral 121 denotes a point C' and 122 indicates a point D'. The points C' and D' are both ends of the phosphor pattern 108. Reference numeral 117 denotes a point C and 118 indicates a point D. The points C and D are points obtained by projecting the points C' 121 and D' 122 to the neutral plane 114 of the face plate. When a distance between the points C and D is assumed to be L, a distance between the points C' and D' is also equal to L. That is, the phosphor pattern 108 is formed so as to be longer (larger) than the electron source pattern 107 by δ.

FIG. 4 is a schematic cross sectional view of the panel 104 obtained after the sealing step. Reference numeral 112 denotes a neutral plane of the panel 104. The panel 104 is warped by a warp amount h in a region where an image is displayed (almost the same region as the phosphor pattern 108). The neutral plane 112 of the panel 104 is warped at a radius of curvature R. This radius of curvature is assumed to be a representative radius of curvature. The representative radius of curvature is equal to or larger than tens of meter. Therefore, when a distance between the rear plate and the face plate is equal to about a few millimeter and a thickness of each of the face plate and the rear plate is equal to about a few millimeter, a radius of curvature of each of the rear plate 101 and the face plate 102 is almost equal to the representative radius of curvature.

Since a length of neutral plane of the rear plate 101 and a length of neutral plane of the face plate 102 are almost equal, an arc AB=L−δ and an arc CD=L. However, since the rear plate 101 and the face plate 102 are warped, it is necessary to form them so that the electron-emitting device pitch and the phosphor pitch are made different. This point is expressed by the following equations.

$$\begin{aligned}\mathrm{Arc}A'B' &= \mathrm{arc}AB \times [1 + T_1/(2R)] \\ &= (L-\delta) \times [1 + T_1/(2R)] \\ \mathrm{Arc}C'D' &= \mathrm{arc}CD \times [1 - T_2/(2R)] \\ &= L \times [1 - T_2/(2R)]\end{aligned}$$

where, $T_1$: thickness of rear plate 101

$T_2$: thickness of face plate 102

To eliminate the positional deviation, it is necessary that a point O and the points A' and C' are aligned on a straight line and, at the same time, the point O and the points B' and D' are aligned on a straight line. Assuming that a distance between the rear plate 101 and the face plate 102 is equal to S, it is preferable that the following equation is satisfied.

$$\mathrm{Arc}\ C'D' = \mathrm{arc}\ A'B' \times [1+S/(2R)]$$

The above calculations are executed. For simplicity of the calculations, it is assumed that each of $T_1$, $T_2$, and S is equal to about a few millimeter, δ is equal to or less than 1 mm, L is equal to about 1 m, and R is equal to about tens of meter and the term whose value is very small is ignored. Thus, the following result which is substantially correct is obtained.

$$\delta = L[(T_1+T_2)/2+SJ/R$$

where, $[(T_1+T_2)/2+S]$ coincides with the distance between the neutral plane 113 of the rear plate 101 and the neutral plane 114 of the face plate 102. That is, assuming that the distance between the neutral plane 113 of the rear plate 101 and the neutral plane 114 of the face plate 102 is set to T, $$\delta = TL/R$$

Further, there is a relation of the following equation between the warp amount h and the radius of curvature.

$$R = L^2/8h$$

The following equation is obtained by using the above equation.

$$\delta = 8Th/L$$

That is, it is sufficient to set the size of electron source pattern 107 to be smaller than the size of phosphor pattern 108 by δ. When expressing it in a manner of a reduced scale, it is sufficient to set the size of electron source pattern 107 to be K times as large as the size of phosphor pattern 108.

$$K = (L-\delta)/L = (L-TL/R)/L = 1-T/R$$

Figure 5:
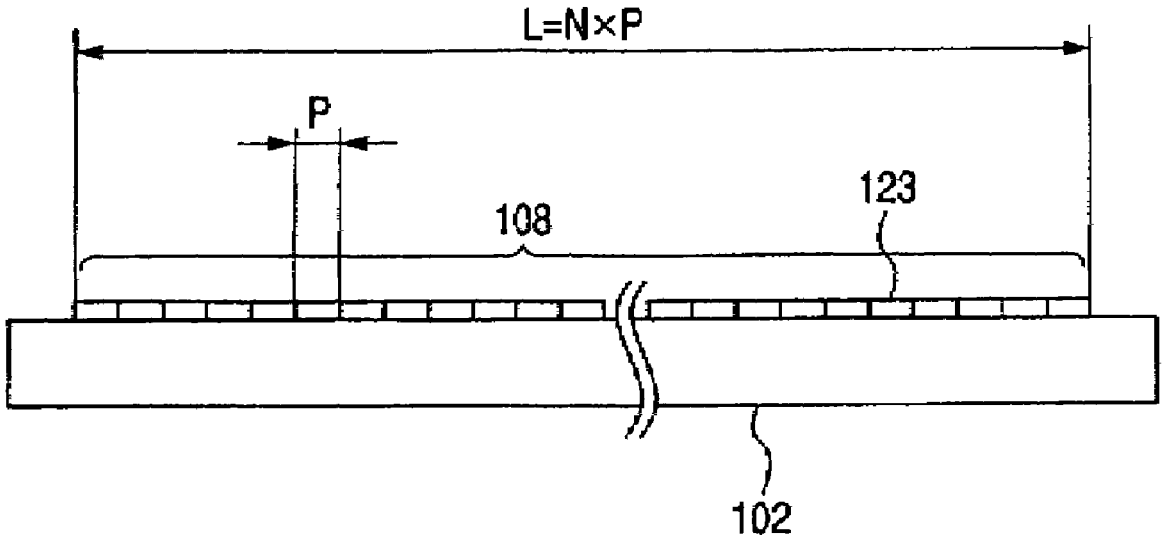
FIG. 5 is a diagram for explaining a phosphor pattern.

The phosphor pattern and the electron source pattern shown in FIGS. 5 and 6 will now be described. In FIG. 5, reference numeral 123 denotes phosphor. In the cross sectional view, the phosphor pattern 108 is constructed by N phosphor (light-emitting members) 123. The light-emitting members are arranged at an equal pitch and assuming that the pitch is equal to P, a size L of phosphor pattern is defined by the following equation.

$$L = N \times P$$

Figure 6:
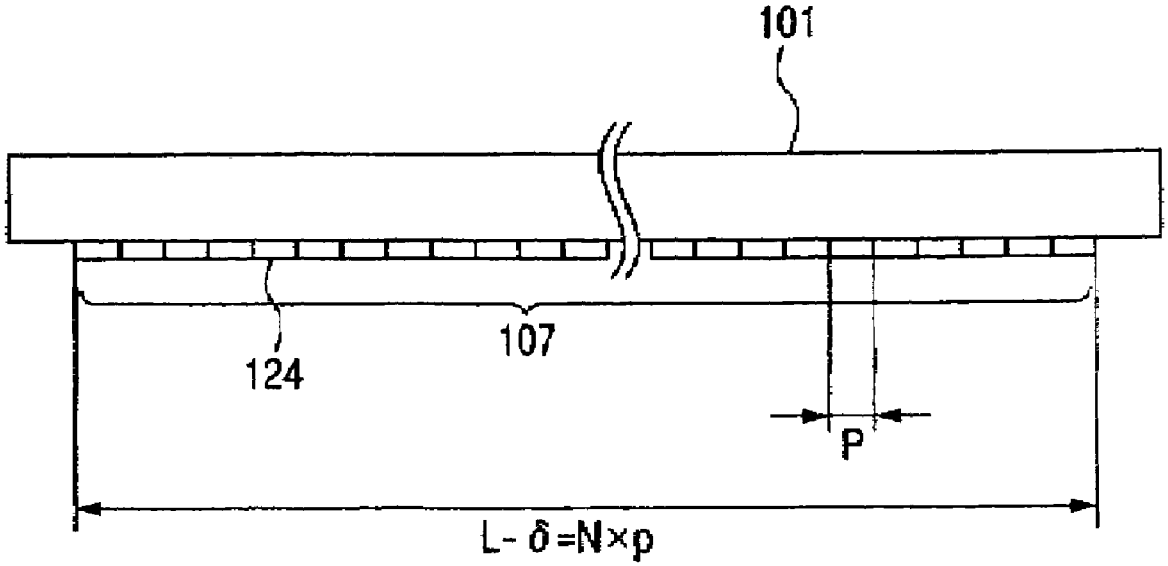
FIG. 6 is a diagram for explaining an electron source pattern.

In FIG. 6, reference numeral 124 denotes electron-emitting devices. The electron source pattern 107 is constructed by the N electron-emitting devices 124. The electron-emitting devices are arranged at an equal pitch and this pitch is assumed, to be p, the size L−δ of the electron source pattern is expressed by the following equation.

$$L-\delta = N \times p$$

Thus, it is sufficient to set p as follows.

$$p = P-\delta/N = P-TL/NR$$

Figure 15:
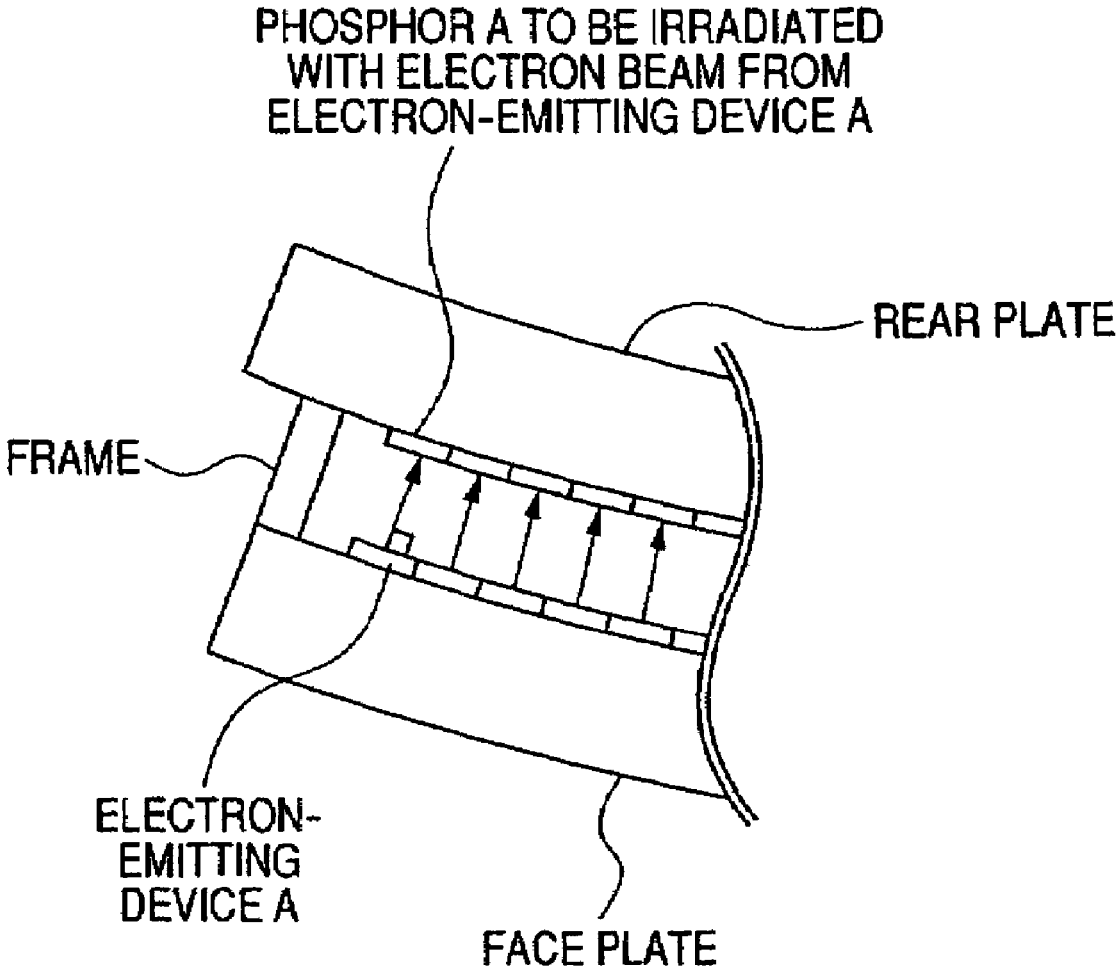
FIG. 15 is a partial enlarged diagram of an image display apparatus to which the invention is applied.

FIG. 15 shows a partial enlarged diagram of an image display apparatus to which the invention is applied.

T denotes the distance between the neutral plane 113 of the rear plate 101 and the neutral plane 114 of the face plate 102. Therefore, the larger the substrate thickness of the rear plate 101 or the face plate 102 is, the larger a value of T is. The larger the distance between the rear plate 101 and the face plate 102 is, the larger the value of T is. Consequently, in the FED type image display apparatus in which the distance between the rear plate 101 and the face plate 102 needs to be set to a value within a range of about 0.5 to 3 mm or more, the positional deviation due to the warp is large and the invention is very effective.

The larger the panel size is, the higher definition in the panel sealing process or the like is necessary and the more the warp amount increases. Therefore, a value of h/L increases with an increase in panel size L. Thus, the larger the panel size is, the more the invention becomes effective.

In the above embodiment, the flat panel type image display apparatus using the surface conduction type electron-emitting devices as an electron source has been shown. However, the invention is not limited to such an apparatus. A similar effect is also obtained in a flat panel type image display apparatus using field emission type electron-emitting devices or the like as an electron source, a PDP, or the like.

EMBODIMENTS

First Embodiment

Figure 7:
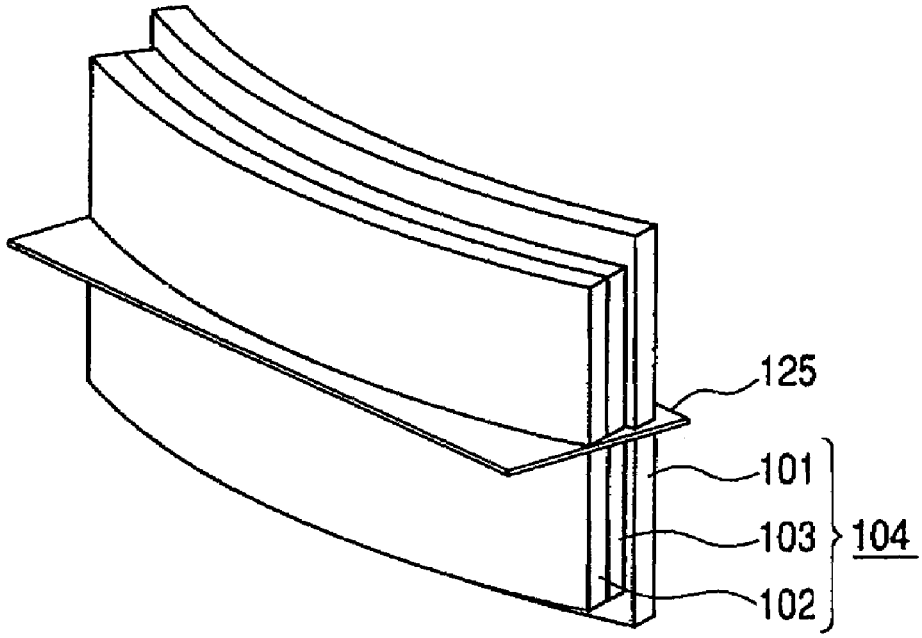
FIG. 7 is a schematic perspective view for explaining the first embodiment.

FIG. 3 is a diagram for explaining the first embodiment. The rear plate 101 is a glass substrate having a thickness of $T_1$=2.8 mm. The face plate 102 is a glass substrate having a thickness of $T_2$=2.8 mm. The panel 104 shown in FIG. 7 is formed by sealing the rear plate 101, face plate 102, and frame 103 by using a sealing material (not shown) by the sealing process. The panel 104 is warped in a convex shape in the direction directing from the rear plate 101 to the face plate 102 and has an almost circular shape. In the panel 104, the distance between the rear plate 101 and the face plate 102 is equal to 2 mm.

In FIG. 7, reference numeral 125 denotes a cross sectional plane E to observe a cross sectional structure of the panel 104. FIG. 4 shows a cross sectional schematic diagram of the panel 104 cut at the plane E 125. It has previously been known that the warp amount h of 1 mm occurs due to the sealing process, mainly, by heating temperature characteristics of a sealing apparatus. A radius of curvature in this case is equal to about 77 m.

The length L of phosphor pattern 108 is equal to 787.2 mm. The electron source pattern 107 has to be formed so as to be smaller than the length of phosphor pattern by δ in consideration of the positional deviation due to the warp. The electron source is constructed by a plurality of surface conduction type electron-emitting devices. When δ is calculated, it is equal to 49 μm. Therefore, the electron source pattern 107 is formed so that its length is equal to 787.151 mm. The phosphor pitch P is set to 205 μm. Therefore, when the panel is sealed and bonded so that the positional deviation does not occur at the center of the phosphor pattern 108, a positional deviation of 24.5 μm occurs at both ends of the phosphor pattern 108. Non-light emitting regions each having a width of 30 μm and called a black matrix are formed among a plurality of light-emitting members although not shown. Therefore, in the display apparatus which does not use the invention, a bombarding position of the electron beam is deviated, the electron beam is bombarded to the non-light emitting region, and the luminance decreases. However, the good image can be obtained by taking the countermeasure of the invention.

Second Embodiment

Figure 8:
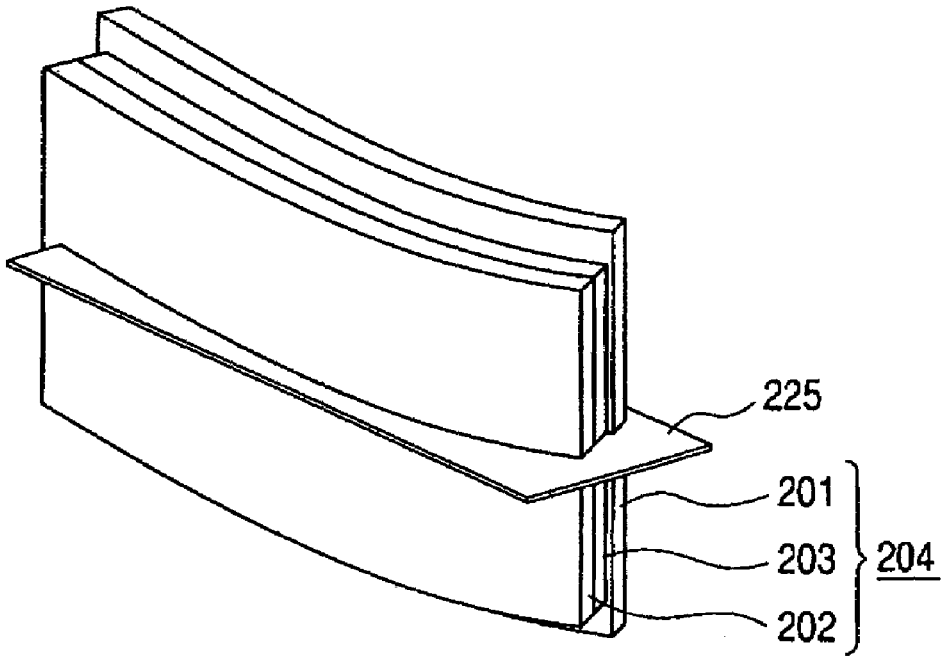
FIG. 8 is a schematic perspective view for explaining the second embodiment.

FIG. 8 is a diagram for explaining the second embodiment. A rear plate 201 is a glass substrate having a thickness of $T_1$=2.8 mm. A face plate 202 is a glass substrate having a thickness of $T_2$=2.8 mm. A panel 204 shown in FIG. 8 is formed by sealing the rear plate 201, face plate 202, and frame 203 by using the sealing material (not shown) by the sealing process. The panel 204 is warped in a convex shape in the direction directing from the rear plate 201 to the face plate 202 and is in a non-flat surface state. In the panel 204, a distance between the rear plate 201 and the face plate 202 is equal to 1.6 mm.

Figure 9:
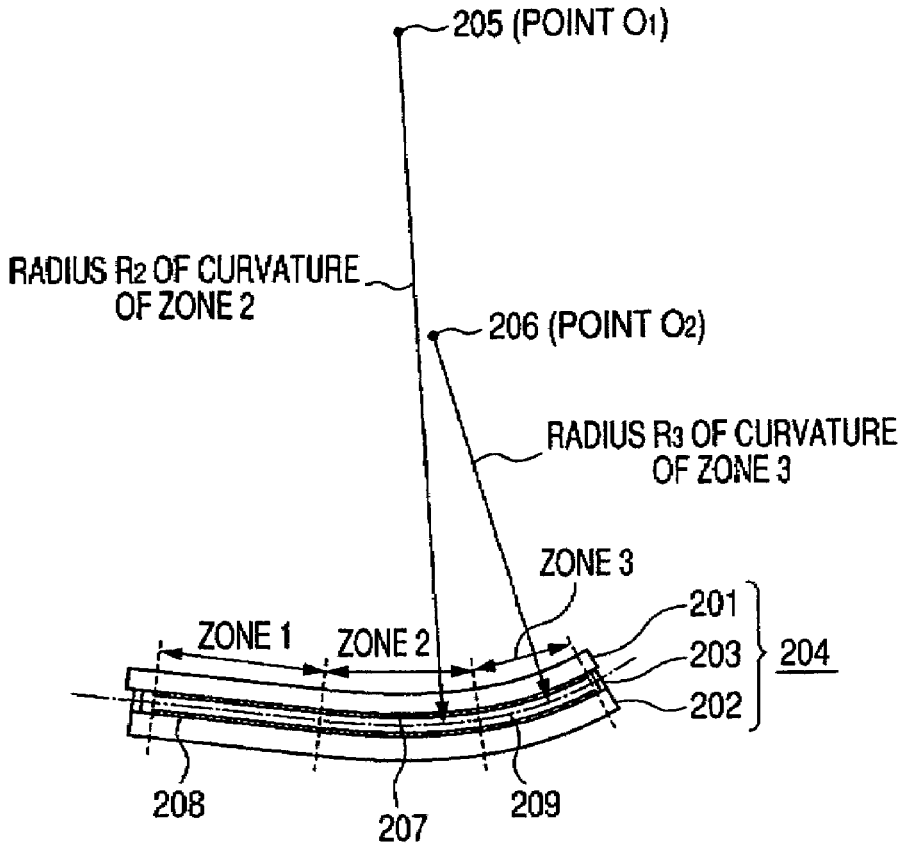
FIG. 9 is a schematic cross sectional view of a panel 204.

In FIG. 8, reference numeral 225 denotes a cross sectional plane F to observe a cross sectional structure of the panel 204. FIG. 9 shows a cross sectional schematic diagram of the panel 204 cut at the plane F 225. The panel 204 has a non-flat surface shape due to the sealing process and its states in three zones are different. In terms of this point, such a shape has been presumed by the sealing process, mainly, by the heating temperature characteristics of the sealing apparatus. In a zone 1, there is no warp in the panel shape and the rear plate 201 and the face plate 202 are almost flat surfaces. In a zone 2, the panel shape is a cylindrical shape having a radius of curvature $R_2$ while a point $O_1$ 205 is set to the center. In a zone 3, although the panel shape is a cylindrical shape, its radius of curvature differs from that in the zone 2, that is the panel shape is the cylindrical shape having a radius of curvature $R_3$ while a point $O_2$ 206 is set to the center. By measuring the shapes of the panels and the like, it has been found that $R_2$=100 m and $R_3$=60 m. The zones 1, 2, and 3 are obtained by dividing a phosphor pattern 208 into almost three equal regions.

In the zone 1, since there is no radius of curvature, when the positional deviation due to the warp occurs, the positional deviation amounts are equal in the zone 1.

Since the panel shape as mentioned above has previously been known by the heating temperature characteristics of the sealing apparatus, the pattern which eliminates the positional deviation is prepared.

A length of phosphor pattern 208 is set to L=787.2 mm. On the other hand, in order to decide a length of electron source pattern 207, $\delta_1$, $\delta_2$, and $\delta_3$ in the zones 1, 2, and 3 are obtained.

$\delta_1$=0 mm. $\delta_2$=11.5 μm when the radius of curvature of 100 m is used for the length of about 262 mm. $\delta_3$=19.2 μm when the radius of curvature of 60 m is used for the length of about 262 mm.

The electron source pattern is constructed by 7680 electron-emitting devices (not shown). In FIG. 9, 2566 electron-emitting devices are included in the zone 1, 2560 electron-emitting devices are included in the zone 2, and 2560 electron-emitting devices are included in the zone 3. The panel is sealed and bonded so that the relative positional deviation does not occur in the center electron-emitting device and phosphor of the zone 2, that is, in the 3840th electron-emitting device from the edge and phosphor. The electron source pattern including the 3840 electron-emitting devices of the zone 2 is, manufactured so as to have a length of 262.3885 mm which is smaller than the phosphor pattern (262.4 mm) by 11.5 μm. The electron source pattern including the 3840 electron sources of the zone 1 is manufactured so as to have the same length of 262.4 mm as that of phosphor pattern (262.4 mm) in the state where it is connected to the left side of the zone 2 in the diagram. The electron source pattern including the 3840 electron sources of the zone 3 is manufactured so as to have a length of 262.3808 mm which is smaller than the phosphor pattern (262.4 mm) by 19.2 μm in the state where it is connected to the right side of the zone 2 in the diagram.

That is, the positional deviation can be eliminated by allocating the electron source pattern 207 having three pattern pitches of the zones 1, 2, and 3 to the phosphor pattern 208 having a predetermined pattern pitch.

Finally, it is sufficient to form the electron source pattern 207 so as to be smaller than the phosphor pattern by 31 μm. Therefore, the length of electron source pattern 207 is equal to 787.169 mm.

The electron-emitting devices are the surface conduction electron-emitting devices.

The phosphor pitch is set to 102.5 μm. When the same electron source pattern as the phosphor pattern is used without considering the positional deviation, if the panel is sealed and bonded so that no positional deviation occurs at the center of the phosphor pattern 208, the positional deviation of 15.5 μm has occurred at each of both ends of the phosphor pattern 208. The non-light emitting regions (not shown) each having a width of 12 μm and called a black matrix are formed among a plurality of light-emitting members. Therefore, in the display apparatus which does not use the invention a bombarding position of the electron beam is deviated, the electron beam is bombarded to the adjacent light-emitting member, and the decrease in luminance and the color drift occur. However, the good image can be obtained by taking the countermeasure of the invention.

Third Embodiment

Figure 10:
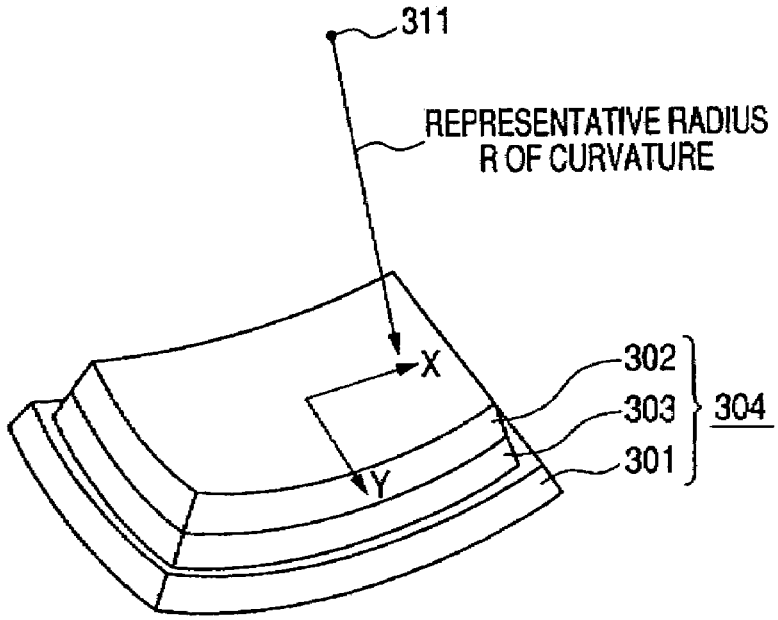
FIG. 10 is a schematic perspective view for explaining the third embodiment.

FIG. 10 is a diagram for explaining the third embodiment. A rear plate 301 is a glass substrate having a thickness of $T_1$=1.8 mm. A face plate 302 is a glass substrate having a thickness of $T_2$=1.8 mm. A panel 304 is formed by sealing the rear plate 301, face plate 302, and frame 303 by using the sealing material (not shown) by the sealing process. The panel 304 is warped in a convex shape in the direction directing from the face plate 302 to the rear plate 301. In the panel 304, a distance between the rear plate 301 and the face plate 302 is equal to 2 mm.

By measuring a 3-dimensional shape, it has been found that the panel has an almost spherical shape whose radius of curvature is equal to about 85 m (R=85 m). Such a shape has been presumed by the sealing process, mainly, by the heating temperature characteristics of the sealing apparatus.

Since the panel has the convex shape in the direction directing from the face plate 302 to the rear plate 301, an electron source pattern which is formed on the rear plate 301 has to be larger than a phosphor pattern which is formed on the face plate 302.

Figure 11:
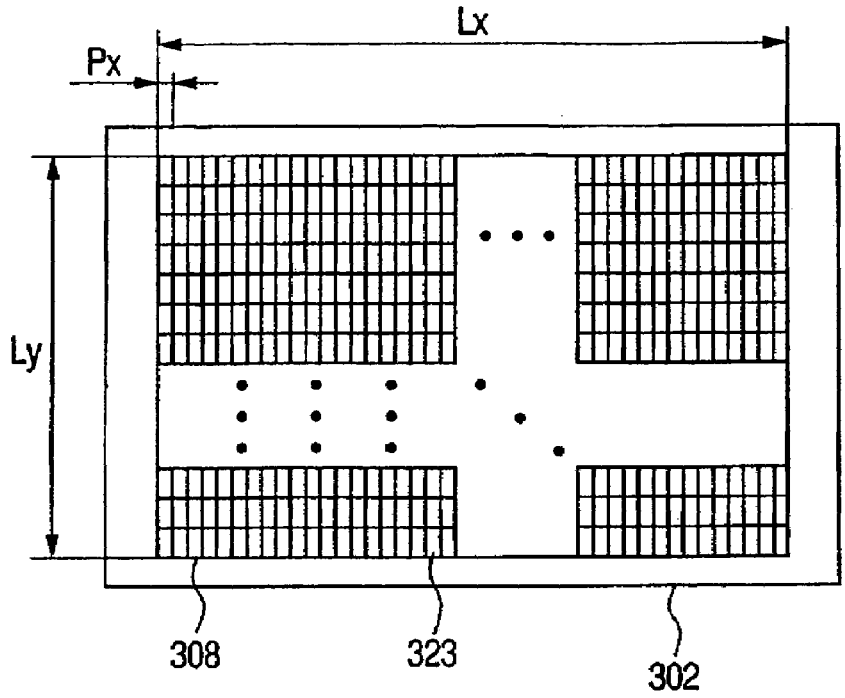
FIG. 11 shows a phosphor pattern 308 which is formed on a face plate.
Figure 12:
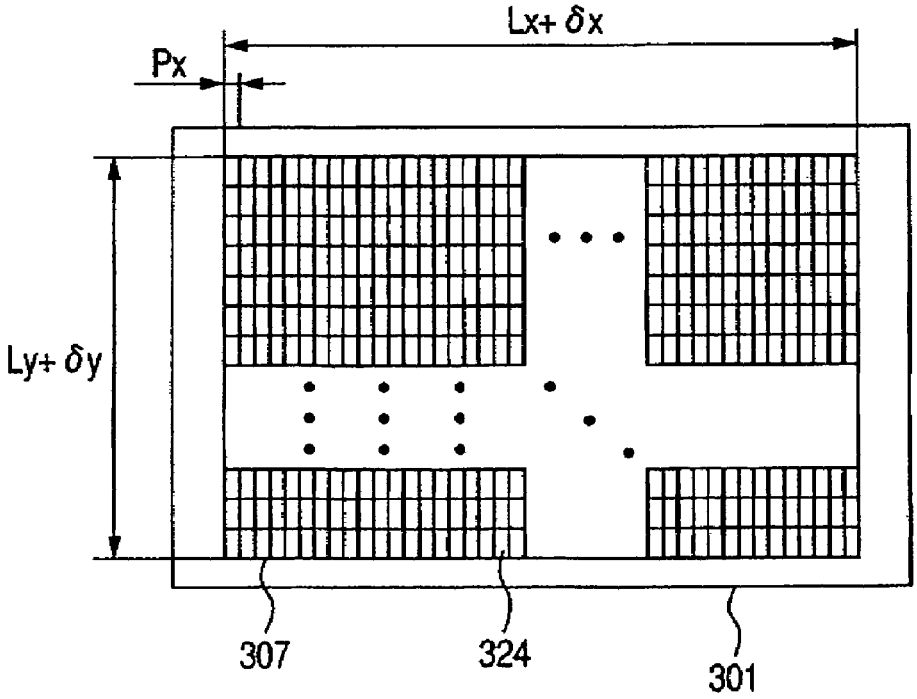
FIG. 12 shows an electron source pattern 307 which is formed on a rear plate.
Figure 13:
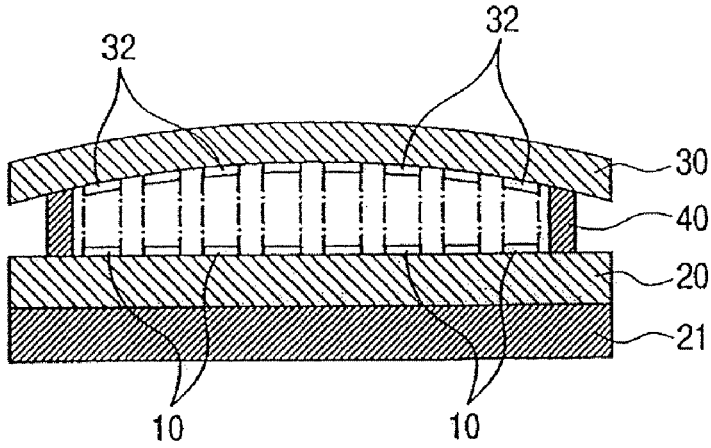
PRIOR ART FIG. 13
FIG. 13 shows a prior art.
Figure 14:
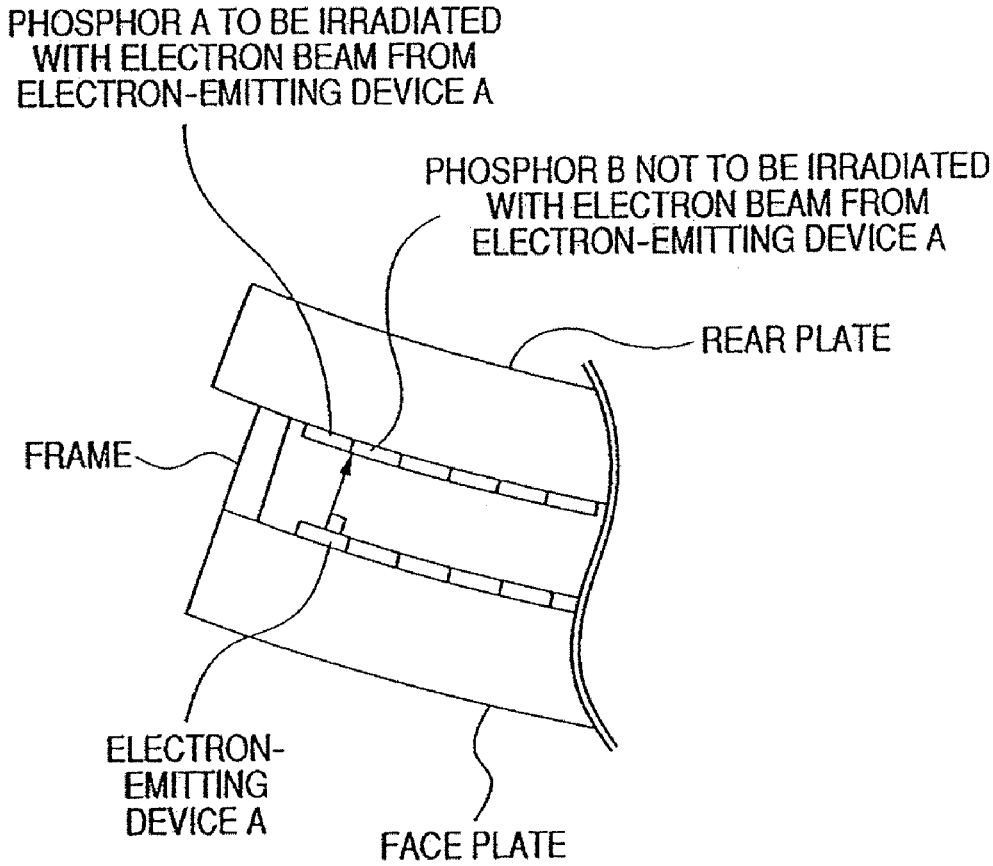
FIG. 14 is a partial enlarged diagram for explaining the problem.

FIG. 11 shows a phosphor pattern 308 which is formed on the face plate. FIG. 12 shows an electron source pattern 307 which is formed on the rear plate. The phosphor pattern 308 is formed by a plurality of phosphor (light-emitting members) 323. The electron source pattern 307 is formed by a plurality of electron-emitting devices 324. As a size of phosphor pattern, a length in the X direction (longitudinal direction) is assumed to be Lx and a length in the Y direction (short-side direction) is assumed to be Ly. It is sufficient that the length in the X direction of the electron source pattern 307 is set to be larger than Lx by δx, that is, (Lx+δx) in order to correct the positional deviation due to the warp and the length in the Y direction of the electron source pattern 307 is set to be larger than Ly by δy, that is, (Ly+δx).

According to the above examination, Lx is equal to 985.9 mm, an X-directional pitch Px of the electron-emitting devices 324 is equal to 0.514 mm, Ly is equal to 554.6 mm, a Y-directional pitch Py of the electron-emitting devices 324 is equal to 0.514 mm. Thus, δx=41.8 μm and δy=23.5 μm.

Therefore, the electron source pattern 307 is not made coincident with the phosphor pattern 308 but the length Lx in the X direction is set to 985.942 mm which is larger by 41.8 μm and the length Ly in the Y direction is set to 554.624 mm which is larger by 23.5 μm.

The electron-emitting devices are the surface conduction electron-emitting devices.

When the image is displayed onto the panel, the good image without decrease in luminance can be obtained.

Although the invention has been described above with respect to the embodiments, the invention is not limited to them. For example, as for the convex shape in each embodiment, when the convex shape directing from the rear plate to the face plate is changed to the convex shape directing from the face plate to the rear plate, it can be realized by replacing the relation between the electron-emitting device pitch and the phosphor pitch. Similarly, when the convex shape directing from the face plate to the rear plate is changed to the convex shape directing from the rear plate to the face plate, it can be realized by replacing the relation between the electron-emitting device pitch and the phosphor pitch.

As described above, according to the invention, by changing the sizes of the phosphor pattern and the rear plate pattern or by changing the pattern pitch, the relative positional deviation due to the warp is eliminated and the image forming apparatus without the luminance variation and the color drift can be manufactured.

This application claims priority from Japanese Patent Application No. 2004-379827filed on Dec. 28, 2004, which is hereby incorporated by reference herein.

What is claimed is:

1. A display apparatus comprising:

a first plate-shaped member having a plurality of electron-emitting devices which are dispersively distributed; and a second plate-shaped member having a plurality of light-emitting members arranged on a surface which faces said first plate-shaped member in correspondence to said plurality of electron-emitting devices, in which, in at least either said first plate-shaped member or said second plate-shaped member, directions of normal lines extending from said plurality of electron-emitting devices or said plurality of light-emitting members are distributed in a tendency, wherein a pitch between at least one of the electron-emitting devices and an electron-emitting device adjacent to that at least one electron-emitting device and a pitch between a light-emitting member corresponding to the at least one electron-emitting device and a light-emitting member adjacent to the at least one light-emitting member are different so that an electron emitted from each of said plurality of electron-emitting devices is irradiated to each of said plurality of corresponding light-emitting members, wherein each of said first plate-shaped member and said second plate-shaped member has a convex shape having a radius of curvature R which is projected in the direction directing from said second plate-shaped member to said first plate-shaped member, a neutral plane of said first plate-shaped member and a neutral plane of said second plate-shaped member are located at a distance T, and the pitch of arranging said electron-emitting devices is 1+T/R times as large as the pitch of arranging said light-emitting members.

2. A display apparatus comprising:

a first plate-shaped member having a plurality of electron-emitting devices which are dispersively distributed; and a second plate-shaped member having a plurality of light-emitting members arranged on a surface which faces said first plate-shaped member in correspondence to said plurality of electron-emitting devices, in which, in at least either said first plate-shaped member or said second plate-shaped member, directions of normal lines extending from said plurality of electron-emitting devices or said plurality of light-emitting members are distributed in a tendency, wherein a pitch between at least one of the electron-emitting devices and an electron-emitting device adjacent to that at least one electron-emitting device and a pitch between a light-emitting member corresponding to the at least one electron-emitting device and a light-emitting member adjacent to the at least one light-emitting member are different so that an electron emitted from each of said plurality of electron-emitting devices is irradiated to each of said plurality of corresponding light-emitting members, wherein each of said first plate-shaped member and said second plate-shaped member has a convex shape having a radius of curvature R which is projected in the direction directing from said first plate-shaped member to said second plate-shaped member, a neutral plane of said first plate-shaped member and a neutral plane of said second plate-shaped member are located at a distance T, and the pitch of arranging said electron-emitting devices is 1−T/R times as large as the pitch of arranging said light-emitting members.

3. A display apparatus comprising:

a first plate-shaped member having a plurality of electron-emitting devices which are dispersively distributed; and a second plate-shaped member having a plurality of light-emitting members arranged on a surface which faces said first plate-shaped member in correspondence to said plurality of electron-emitting devices, in which, in at least either said first plate-shaped member or said second plate-shaped member, directions of normal lines extending from said plurality of electron-emitting devices or said plurality of light-emitting members are distributed in a tendency, wherein a pitch between at least one of the electron-emitting devices and an electron-emitting device adjacent to that at least one electron-emitting device and a pitch between a light-emitting member corresponding to the at least one electron-emitting device and a light-emitting member adjacent to the at least one light-emitting member are different so that an electron emitted from each of said plurality of electron-emitting devices is irradiated to each of said plurality of corresponding light-emitting members, wherein each of said first plate-shaped member and said second plate-shaped member has n regions each having a convex shape which is projected in the direction directing from said second plate-shaped member to said first-plate shaped member, n being an integer having a value of 2 or more such that n2, a radius of curvature of each of said plurality of regions is equal to Rn, a distance between a neutral plane of said first plate-shaped member and a neutral plane of said second plate-shaped member is equal to T, and the pitch of arranging said electron-emitting devices in each of said plurality of regions is 1+T/Rn times as large as the pitch of arranging said light-emitting-members.

4. A display apparatus comprising:

a first plate-shaped member having a plurality of electron-emitting devices which are dispersively distributed; and a second plate-shaped member having a plurality of light-emitting members arranged on a surface which faces said first plate-shaped member in correspondence to said plurality of electron-emitting devices, in which, in at least either said first plate-shaped member or said second plate-shaped member, directions of normal lines extending from said plurality of electron-emitting devices or said plurality of light-emitting members are distributed in a tendency, wherein a pitch between at least one of the electron-emitting devices and an electron-emitting device adjacent to that at least one electron-emitting device and a pitch between a light-emitting member corresponding to the at least one electron-emitting device and a light-emitting member adjacent to the at least one light-emitting member are different so that an electron emitted from each of said plurality of electron-emitting devices is irradiated to each of said plurality of corresponding light-emitting members, wherein each of said first plate-shaped member and said second plate-shaped member has n regions each having a convex shape which is projected in the direction directing from said first plate-shaped member to said second plate-shaped member, n being an integer having a value of 2 or more such that $n \geqq 2$, a radius of curvature of each of said plurality of regions is equal to Rn, a distance between a neutral plane of said first plate-shaped member and a neutral plane of said second plate-shaped member is equal to T, and the pitch of arranging said electron-emitting devices in each of said plurality of regions is 1−T/Rn times as large as the pitch of arranging said light-emitting members.

* * * * *